US008607831B2

(12) United States Patent
Doglioni Majer

(10) Patent No.: US 8,607,831 B2
(45) Date of Patent: Dec. 17, 2013

(54) CUP CONVEYOR AND HOLDER DEVICE FOR BEVERAGE DISPENSING

(75) Inventor: Luca Doglioni Majer, Carate Urio (IT)

(73) Assignee: Rhea Vendors, S.p.A. (IT)

( * ) Notice: Subject to any disclaimer, the term of this patent is extended or adjusted under 35 U.S.C. 154(b) by 857 days.

(21) Appl. No.: 12/160,232

(22) PCT Filed: Jan. 16, 2007

(86) PCT No.: PCT/IB2007/000107

§ 371 (c)(1),
(2), (4) Date: Aug. 7, 2008

(87) PCT Pub. No.: WO2007/085926

PCT Pub. Date: Aug. 2, 2007

(65) Prior Publication Data

US 2009/0044876 A1 Feb. 19, 2009

(30) Foreign Application Priority Data

Jan. 24, 2006 (EP) ..... 06001415

(51) Int. Cl.
*B65B 43/42* (2006.01)

(52) U.S. Cl.
USPC ..... 141/174; 141/177; 221/27

(58) Field of Classification Search
USPC ..... 141/129, 168, 173, 174, 177; 221/27
See application file for complete search history.

(56) References Cited

U.S. PATENT DOCUMENTS

| | | | | |
|---|---|---|---|---|
| 2,617,510 | A | 11/1952 | Little | |
| 5,000,345 | A | 3/1991 | Brogna | |
| 5,074,341 | A | 12/1991 | Credle, Jr. | |
| 5,102,086 | A | 4/1992 | Thomason | |
| 5,628,441 | A | 5/1997 | Dykstra | |
| 5,651,523 | A | 7/1997 | Bridges | |
| 5,727,609 | A * | 3/1998 | Knight et al. | 141/129 |
| 5,839,711 | A | 11/1998 | Bieck | |
| 6,135,169 | A * | 10/2000 | Sandei et al. | 141/129 |
| 6,543,637 | B1 | 4/2003 | Osborn | |

* cited by examiner

*Primary Examiner* — Jason K Niesz
(74) *Attorney, Agent, or Firm* — Hess Patent Law Firm LLC; Robert J. Hess

(57) ABSTRACT

A cup conveyor and holder device (1) for a beverage dispensing machine comprises a body (2) into which cups (C1-C3) are vertically dropped for filling with a drink and/or being delivered to the user; the internal surface of the body (2) is provided with at least two steps (3, 4, 8) transversal to the cup dropping direction (X), at different heights of said body (2) with respect to the same direction (X), for vertically supporting said cups (C1, C2, C3) at different diameters.

13 Claims, 4 Drawing Sheets

CUP CONVEYOR AND HOLDER DEVICE FOR BEVERAGE DISPENSING

FIELD OF THE INVENTION

The present invention relates to a cup conveyor and holder device for beverage dispensing machines, in particular a conveyor and holder for cups having different sizes to be used in water, ice and beverage dispensing machines.

BACKGROUND OF THE INVENTION

Hereinafter the word "beverage" is intended to indicate any of coffee, water, ice, drinks, etc.

U.S. Pat. No. 4,738,290, in the name of Francois Ciekanski, discloses a beverage vending machine provided with a motorized apparatus for picking up a cup from a cup stack, positioning the same under a beverage dispensing unit for filling with a drink and, finally, guiding the cup to a delivery recess of the machine accessible by the user. The apparatus comprises a motorized, horizontally rotatable, arm provided with a fork-shaped end portion. Each cup has a frustoconical configuration such that, when dropped from the cup stack, is supported by, and positioned between, the prongs of the fork.

U.S. Pat. No. 5,727,609, in the name of Michael Terence Knight et al., discloses a drink vending machine comprising a cup conveyor apparatus comprising an horizontally moveable arm having a fork-shaped end portion for receiving and holding a cup. The arm receives a cup from a vertical stack and moves the same cup first to a dispensing unit for filling, and thereafter to a delivery position to deliver the cup to an operator or the user.

U.S. Pat. No. 5,074,341, in the name of William S. Credle Jr. et al., discloses an automatic beverage dispensing machine provided with a motorized conveyor for collecting the cups from different sized drop tubes and guiding the same into a filling position. As shown in FIG. 5, the conveyor is provided with an cup holder which can be moved along a rail by an endless screw. The cup holder is made by two L-shaped walls normally arranged to form a support for the cup. The walls are hinged on respective shaft and operated so as to rotate, thereby opening the holder, when the cup has to be dropped.

Other prior art conveyors are known to be provided with a carousel for the positioning of the cups picked up from the drop tubes, disclosed by French patent application FR 2629047, international application WO 99/32392 and Japanese patent JP 3103208.

Prior art solutions have several drawbacks. Motorized conveyors/holders have a complicated design, are difficult to assemble and to operate, are expensive, and require rigorous adjustment of the movement. Motors, switches, end stroke controls, photocells, etc., are often provided for controlling and regulating the movement of the different conveyor parts.

There are several reasons for avoiding the cups from standing on their bottom. For instance, dropped cups can easily bounce upon touching the flat surface, thereby jeopardizing the proper positioning of the same cup. This problem can be serious when the conveyor is for positioning the cups under a beverage dispensing nozzle. If a cup overturns, the nozzle cannot fill the same cup and the dispensed beverage is lost, this leading to a void dispensing cycle. Moreover the beverage flow dispensed by the nozzle, and impinging the overturned cup, can be improperly dispersed within the machine, this easily causing soiling of the same machine and particularly its beverage dispensing area.

Soiling can also occur to cups correctly dropped in the vertical standing position. In fact the flat surface on which the cups stand is subject to soiling by the droplets of the dispensed drinks which come out of the cups or which leak from the dispensing nozzles. This leads to soiling of the cups bottom. Users can be negatively affected by this problem in that they can get dirty while handling the cups.

Another drawback is related to the size of the cups and the filling of the same by one or more dispensing nozzles. When cups having different sizes are provided, typically having a frusto-conical shape with different diameters and/or height, location of the dispensing nozzle(s) within the beverage dispensing machine depends on the distance of the same nozzle (s) from the flat surface on which cups stand. In other words, the dispensing nozzle(s) must be located within the machine at an height from the aforesaid flat surface sufficient for the taller cups to be properly positioned under the nozzle(s). The flat surface is then a reference plane for designing the drink dispensing machine and its cup conveyor. On the contrary, the need is felt for a conveyor and holder which allows for the proper positioning of differently sized cups under the dispensing nozzle(s), independently by the height of the cups.

BRIEF DESCRIPTION OF THE INVENTION

It is an object of the present invention to provide a cup conveyor and holder device for beverage dispensing machines which overcomes the drawbacks of prior art solutions in a simple and effective way, being at the same time easy to manufacture, to assemble and inexpensive.

It is another object of the present invention to provide a cup conveyor and holder device for beverage dispensing machines which allows for the proper positioning of the cups under the dispensing nozzle(s) and/or in a delivery position, at the same preventing the cups from overturning while being dropped.

It is still another object to provide a cup conveyor and holder for beverage dispensing machines, in particular for coffee machines or the like, which allows for the proper positioning of differently sized cups under the dispensing nozzle(s) and/or in a delivery position, independently by the location of the flat surface or base upon which the cups are dropped.

A further object of the present invention is to provide a cup conveyor and holder device for beverage dispensing machines, which comprise multiple beverage delivery areas having multiple cup receptacle sizes for lodging differently sized cups, wherein the distance between the upper edge of each cup and the machine beverage outlet spouts is the minimum.

These and other objects are achieved by the present invention which relates to a cup conveyor and holder device for beverage dispensing machine as set forth in claim 1.

The cups abut the steps at their outer side surface, preferably at their top edge portion. Cups, which have a frusto-conical shape and a lateral projecting upper edge, are intended to abut the respective step provided within the conveyor and holder. Abutting of a cup on the step occurs at its upper edge. In other words the upper edge of a cup dropped into the body of the conveyor abuts the correspondent step, provided at a precise height of the conveyor body to match the diameter of such edge. It is understood that cups can abut the respective step at their outer lateral surface, preferably at their top portion.

Steps are separated along the dropping direction, i.e. they are located at different heights on the conveyor body. A first cup is be held in position by abutting a first step at a first cup diameter. A second cup, having a larger size than the first cup, is held in position by a second step at a second cup diameter.

The first step is arranged at a lower height with respect to the second step. The first step can support the second cup at the first diameter. Advantageously, each cup held in position by the conveyor, stands vertically suspended, ready to be filled with a drink dispensed by the machine nozzle(s) or ready to be picked up by the user, without the same cup touching any surface of the machine with its bottom. In other words, standing of the cups is not achieved by laying the same cups on a flat surface of the beverage dispensing machine, but rather by supporting the cups in a suspended elevated position, with respect to said flat surface. This is achieved by providing, within the conveyor body, one or more supporting surfaces (the steps) for the upper edge of the cups, raised about a sufficient distance from any lower flat surface or base so as to avoid the cup bottom from touching.

The cups are thus held in the desired position, for filling or delivery to the user, without standing on their bottom portion. In this way overturning of the dropped cups is avoided. Cups are effectively guided and positioned within the funnel-shaped inside of the conveyor with no risks for jamming or overturning.

Advantageously, the device according to the present invention allows for properly positioning differently sized cups within beverage dispensing machines, for instance in a position for filling operated by one or more nozzles (positioned in one or more beverage delivery areas) with drinks, or for delivery the cups to the users. This is achieved by providing a plurality of steps corresponding to the number of cup sizes, each step being arranged at an height of said body internal surface. Small size cups, i.e. cups which have the narrower top portion, are supported against gravity by the lower step provided on the internal surface of the body of the conveyor and holder with respect to the cup dropping direction. Large size cups, i.e. cups which have the larger top portion, are supported against gravity by the higher step provided on the same body internal surface.

Each step is preferably obtained by providing a narrowing of the body internal surface. The steps can be continuous or can be defined by separate portions. Alternatively the steps can be obtained by providing one or more opposite projections departing from the body internal surface toward its centre.

Once the cups have been filled with the drink, such as coffee, chocolate, milk, tea, water, cola, ice, etc., they have to be picked up from the conveyor and holder, for instance by the user. The conveyor body is provided with a lateral aperture extending vertically from at least the uppermost step for withdrawal of cups through sliding of the cup upper edge on the respective step. The extension of the width of the lateral aperture at each step is less than the diameter at that step and it is sufficient for the user to remove the cup held in the device according to the invention by sliding the cup along the step, through the lateral aperture.

Preferably, the internal surface of the body of the invention device has a circular cross section and the steps extend along a circumference of the same.

According to another embodiment, the body internal surface is of polygonal cross section and the steps are formed by portions of the polygon sides.

The cup conveyor and holder device is preferably further comprising a plurality of chutes, each of which is used for guiding a cup dropped from a cup reservoir (having one between small size, medium size, large size) to the cup holding body of the conveyor and holder device.

The conveyor device of the invention can be located under a beverage dispensing nozzle for filling the selected cup with the required beverage. In this case, the conveyor and holder device does not require motors, electronic components, switches, etc., to be used. If, on the other hand, the beverage dispensing machine is provided with more than one dispensing nozzles, the invention device will be provided either with two (or more) fixed devices, under the relevant nozzles, or with one device movable from one dispensing nozzle to the other.

Advantageously, the device according to the present invention is simple to design, manufacture and assemble, thereby allowing for reducing the related costs. Suitable materials for manufacturing the conveyor and holder are metal (e.g. dye-cast) and thermoplastics.

A beverage dispensing machine provided with the above mentioned conveyor and holder device is a further object of the invention.

The invention is also related to a method for delivering a beverage from a beverage dispensing machine to a first cup, having a first size, and a second cup, having a second size. The method comprises the step of conveying and holding said first cup at a first height of said machine and said second cup at a second height of said machine, with respect to the cup dropping direction, by means of a device as previously discussed.

DETAILED DESCRIPTION OF THE INVENTION

Further advantages and features of the present invention will become apparent from the following detailed description with reference to the drawings enclosed as a non-restrictive example, where:

Figure 1:
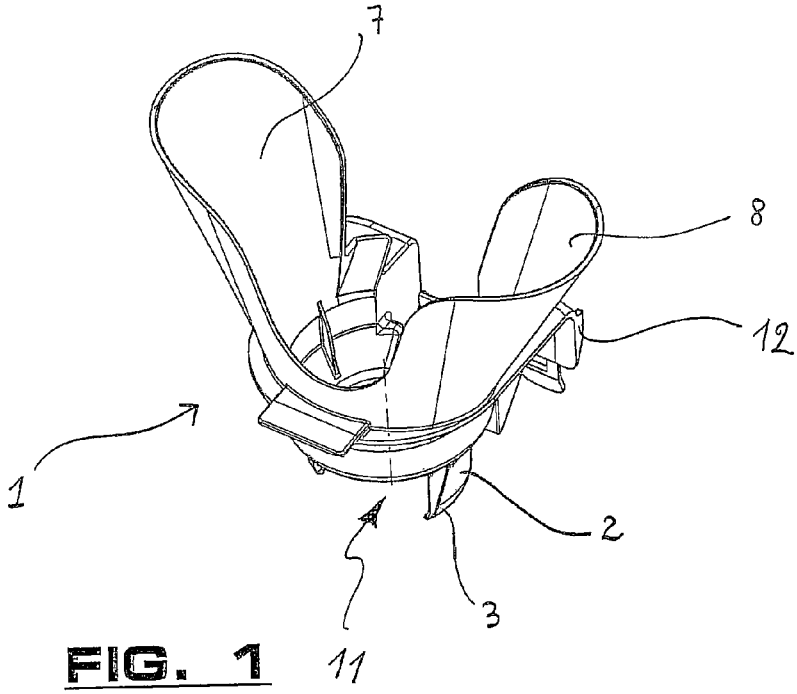
FIG. 1 is a perspective view of a cup conveyor and holder according to the present invention.
Figure 2:
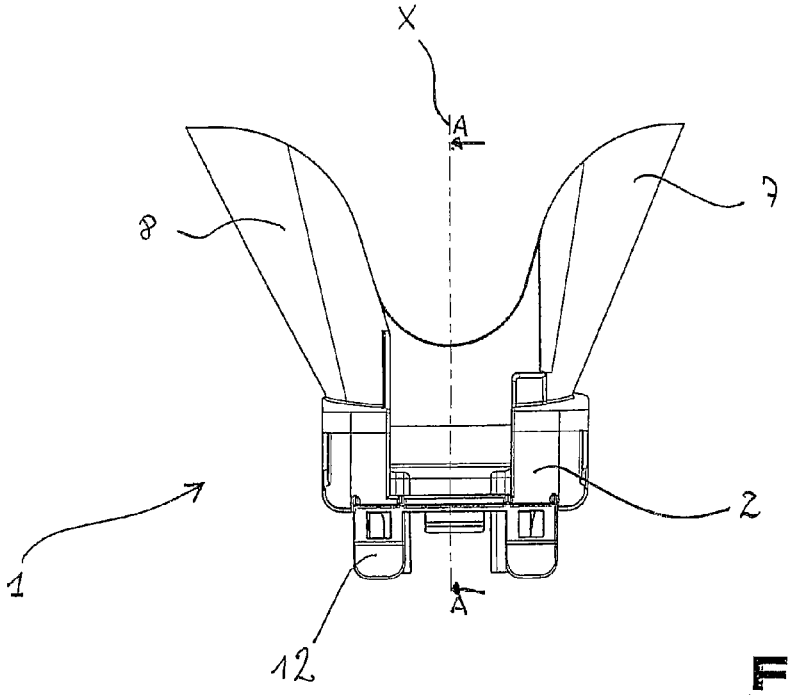
FIG. 2 is a front elevation view of the cup conveyor and holder shown in FIG. 1.

With reference to FIGS. 1-7, a conveyor and holder 1 according to the present invention is shown, provided with a body 2 intended to lodge a cup per time, dropped by a cup dropping unit of the beverage dispensing machine wherein the conveyor and holder is installed.

The body 2 of the conveyor 1 is preferably further comprising, e.g. coupled to chutes having the function of guiding the cups dropped into the conveyor 1. At least a chute is provided. Alternatively a chute can be provided for each dropping unit of the machine. In the embodiment shown in the enclosed figures, the body 2 is coupled to chutes 7 and 8, arranged on opposite sides with respect to the vertical X axis, that is the axis of the cup dropping direction. At the back, the invention device is provided with hanging means 12, e.g. a bracket or similar means, to attach the conveyor and holder 1 to the beverage dispensing machine.

Figure 3:
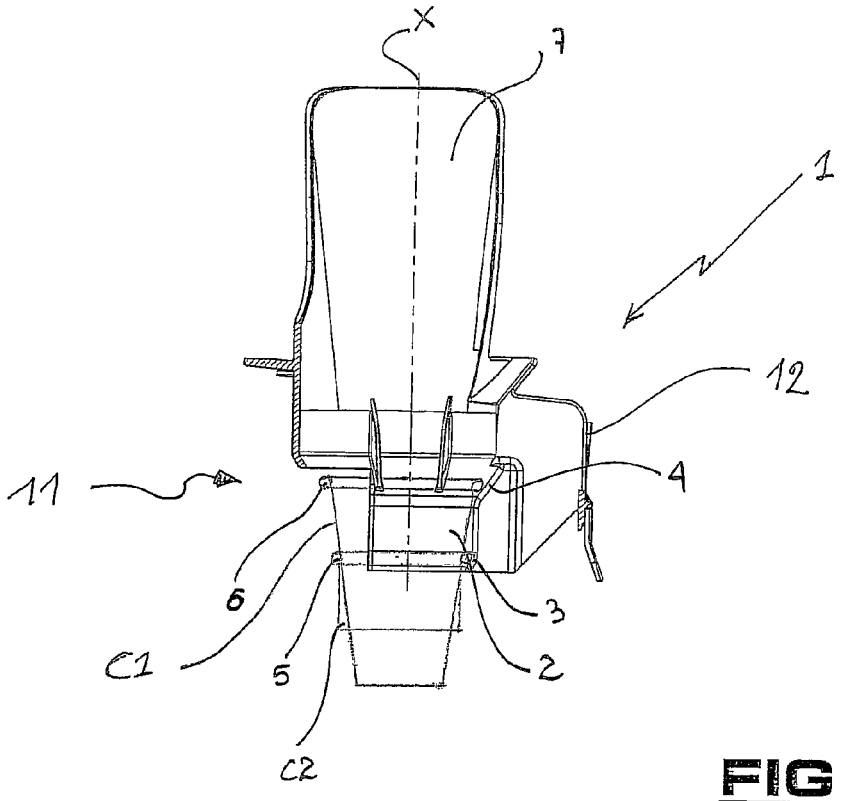
FIG. 3 is a vertical section along line A-A of the cup conveyor and holder shown in FIG. 2.
Figure 4:
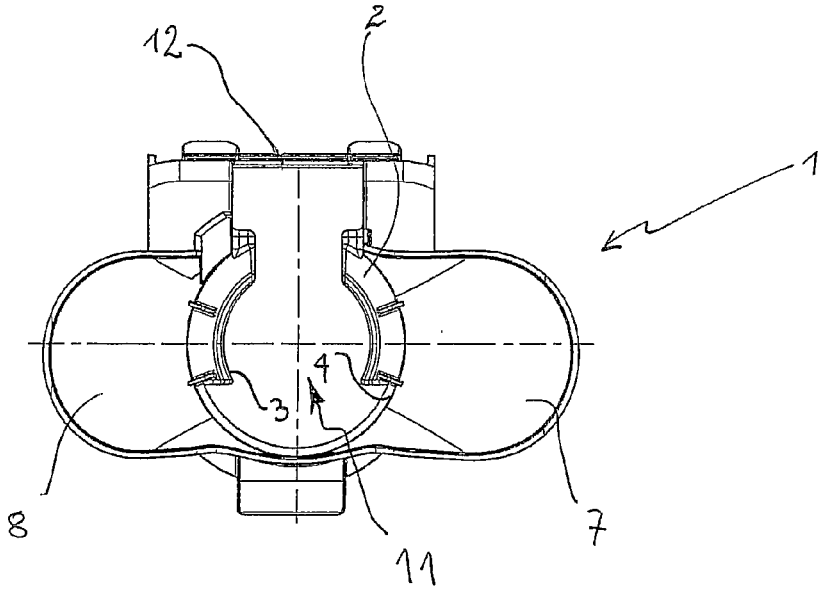
FIG. 4 is a top view of the cup conveyor and holder shown in FIG. 1.
Figure 5:
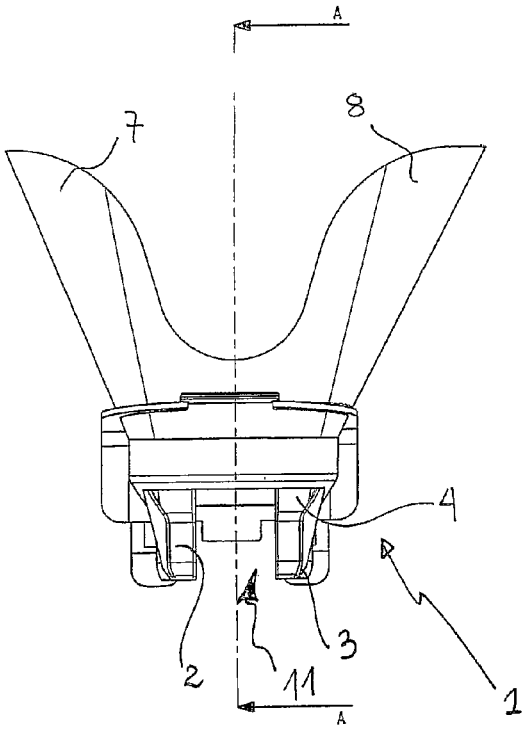
FIG. 5 is an elevation view of the cup conveyor and holder shown in FIG. 1.
Figure 6:
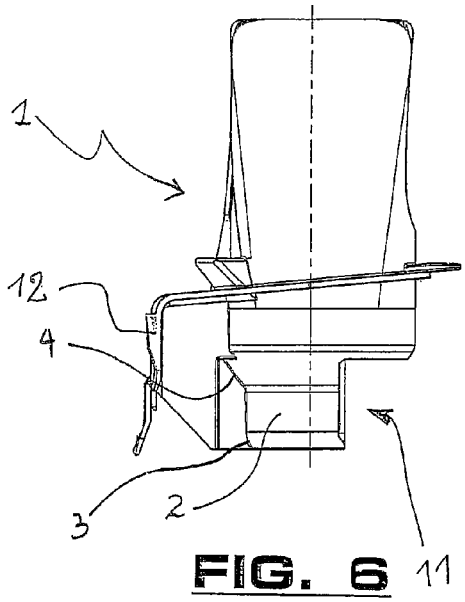
FIG. 6 is a side view of the cup conveyor and holder shown in FIG. 1.
Figure 7:
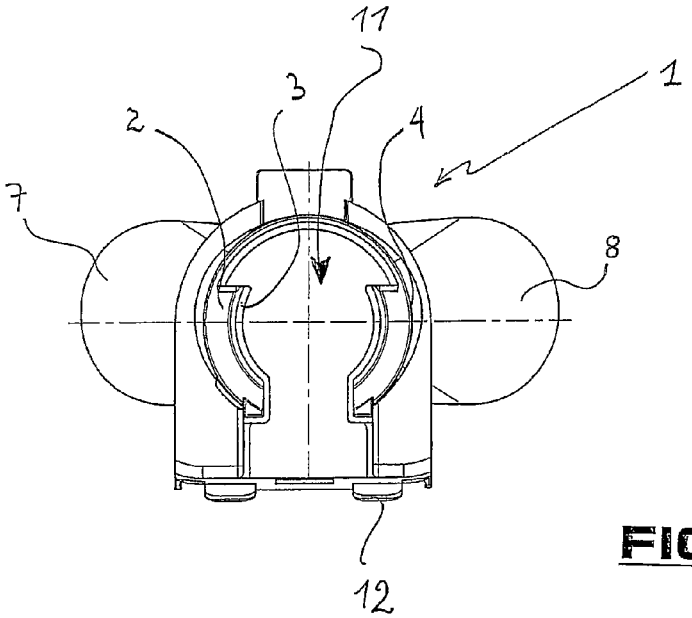
FIG. 7 is a bottom view of the cup conveyor and holder shown in FIG. 1.

The internal surface of the body 2 preferably has a substantially funnel shape to facilitate insertion of the cups, which normally have a frusto-conical configuration. FIG. 3 shows a cross section of the conveyor and holder 1 wherein two cups C1 and C2 are shown, but it is understood that only one cup C1 or C2 is held at a time. Cup C1 is a large size cup and cup C2 is small size. The diameter of the top portion of the cup C1, i.e. the diameter at its projecting top edge 6, is larger than the diameter of the top portion of the cup C2, i.e. the diameter at its projecting edge 5. In the embodiment shown in FIGS. 1-8, the height of cup C1 is greater than the height of cup C2, but it is understood that height of cup C2 can be greater than height of cup C1.

In order to hold a cup C1 or C2 in a position for filling the same and later delivering to the user, the conveyor body 2 is provided with internal steps 3 and 4, which provides an abutment surface respectively for the edge 5 and 6 of the cups C1, C2, thereby avoiding the same cups C1, C2 from further downwards movement under the action of the gravity force.

The conveyor and holder device 1 is provided with a number of internal steps 3, 4, etc., corresponding to the number of cups C1, C2, etc., having different size, i.e. having at least a different diameter of the top portion, that are provided within the dispensing machine.

In the embodiment shown in FIG. 3, the step 3 is for supporting the edge 5 of the small size cup C2, and the step 4 is for supporting the edge 6 of the larger size cup C1. Steps 3 and 4 are each obtained by a narrowing of the body 2 internal surface, forming a "platform" on which the top portions of the cups abut when dropped into the conveyor 1.

The steps 3 and 4 can have different shape, for instance can be a substantially horizontal portion of the body 2 internal surface.

Figure 8:
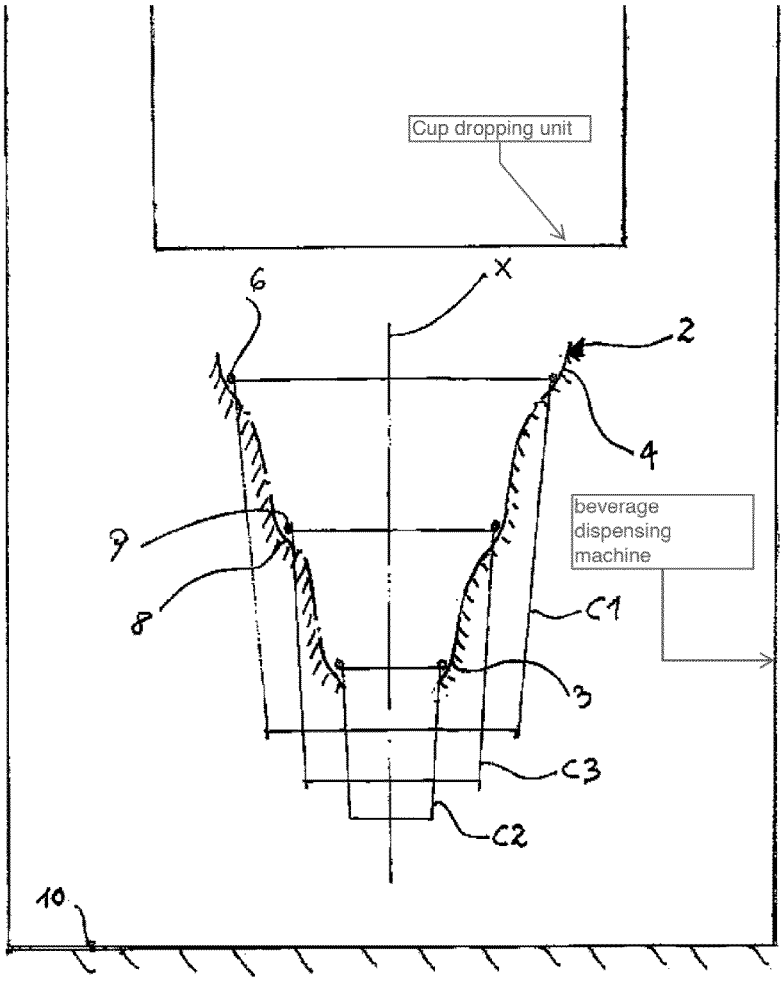
FIG. 8 is a schematic cross-section of the conveyor and holder according to the present invention.

With reference to FIG. 8, it is shown schematically an embodiment for supporting three types of cups C1, C2 and C3, that is a large size cup C1, a small size cup C2 and a medium size cup C3. The last is held in position by the step 8.

As it can be seen in the FIGS. 3 and 8, steps 3, 4 and 8 are positioned at different levels along the body 2 height. In particular, since the body 2 is funnel shaped, the step 3 for the small size cups C2 is the lowermost, with respect to the cup dropping direction X, and the step 4 for the large size cups C1 is the uppermost.

As shown in FIGS. 1-8, the steps 3, 4 and 8 support the upper edges 5, 6 and 9 of the cups C1-C3; edges 5, 6 and 9 laterally projects from the respective cup surface, but it is understood that steps 3, 4 and 8 can support a portion of the cups C1-C3 different from said edges. For instance the cup C1 can match the step 4 with its outer surface, i.e. the coupling between the cup C1 and the step 4 can be a female-male conical coupling. The same applies for cups C2 and C3.

Each of steps 3, 4 and 8 shown in the FIGS. 1-8 runs continuously along the internal surface of the conveyor body 2. As an alternative embodiment, the steps 3, 4 and 8 can be formed by several separate portions, for instance by at least two projections departing from the surface of the body 2 toward its interior.

Advantageously the cups C1-C3 are held in the desired position, for filling or delivery to the user, without standing on their bottom portion.

The conveyor and holder 1 according to the present invention provides supporting the cups C1-C3 at their top portion, thereby preventing the bottom of the same cups C1-C3 from contacting possibly soiled surfaces.

With reference to FIG. 8, another advantage of the conveyor and holder 1 over prior art solutions is that cups C1-C3 are held suspended in the desired position despite of the distance from the flat surface 10 of the beverage dispensing machine. Such flat surface 10 could be even not provided. In other words, the cups C1-C3 are held by the conveyor 1 in their filling position, or in the delivery position, regardless of the surface 10 being provided or not.

The conveyor and holder 1 does not require the beverage dispensing machine to be designed with a lower plane surface 10 for supporting the cups released by the dropping units. Advantageously the location of the drink dispensing nozzle (s) within the machine is not related to the distance from the surface 10. In other words, the beverage dispensing machine can be designed without referring to the surface 10 and to the height of the cups C1-C3.

The invention provides that cups C1-C3 are to be picked up by the user directly from the conveyor device 1. As shown in the figures, the wall of the holding body 2 of the conveyor 1 is provided with a lateral aperture or side opening 11, for allowing the user to access the cups C1-C3 held on the respective steps 3, 4, 8. The aperture 11 extends vertically along holding body 2 from at least the upper step 4, downwards to the bottom end (included) of body 2. The aperture permits the user to handle the cups, e.g. once filled with the required beverage, and remove them transversally with respect to the direction X, from the body 2 of conveyor 1 and from the beverage dispensing machine.

The conveyor 1 comprises no motorized portions or electronic parts, which are usually expensive. The cups C1-C3 are properly guided in the desired position, and held in such a position, in a simple and effective way. The conveyor results inexpensive. It is preferably made of a thermoplastic material, by moulding of several parts.

The conveyor and holder apparatus 1 can be motorized, i.e. it can be moveable between a position for collecting the cups C1-C3 and a position for filling the cups C1-C3, and/or between a position for filling and a position for delivery the cups to the user. This can be achieved by coupling the conveyor 1 to a motor, guides, arms, etc.

Alternatively, being the conveyor and holder apparatus 1 fixed to the dispensing machine, one or more beverage outlet assemblies can be moved to a dispensing position for minimal splashing of the dispensed drink.

The conveyor and holder 1 allows for implementing the following method for delivering a beverage by way of a beverage dispensing machine provided with a first cup C1, having a first size, and a second cup C2, having a second size, to be filled with said beverage. The method comprises the step of dropping one of said first cup C1 or said second cup C2 into at least one beverage dispensing area of the machine. The cup is then filled with the beverage for delivery to the user. Advantageously the method comprises the step of conveying and holding said first cup C1 at a first height and said second cup C2 at a second height, with respect to the cup dropping direction X, vertically supporting the same cups C1, C2 at different diameters against further downward movement.

The invention claimed is:

1. A cup conveyor and holder device (1) for a beverage dispensing machine, comprising funnel shaped conveyor means (7, 8) for guiding cups (C1, C2, C3) dropped into the conveyor means and a cup holding body (2) into which the cups (C1, C2, C3) dropped into the conveyor means are directed to be held for filling with a beverage and delivering to the user, wherein an internal surface of said cup holding body (2) is provided with at least two steps (3, 4, 8), positioned at different heights of said cup holding body (2) with respect to a cup dropping direction (X) and being spaced from each other so that each cup housed in the holder is supported at its upper edge in suspended position that is raised from any surface of said beverage dispensing machine or base of said holder thereby avoiding the bottom of said cups (C1, C2, C3) from touching said any surface of said beverage dispensing machine or base of said holder, said body (2) wall being provided with a lateral aperture (11) extending vertically along said cup holding body and having a width at each step sufficient for withdrawal of cups (C1, C2) by the user through sliding of the cups on respective ones of the steps (3, 4).

2. A cup conveyor and holder device (1) for a beverage dispensing machine, comprising a cup holding body (2) into which cups (C1, C2, C3) of different diameters are dropped for filling with a beverage and delivering to the user, characterized in that an internal surface of said cup holding body (2) is provided with at least two steps (3, 4, 8), positioned at different heights of said cup holding body (2) with respect to the cup dropping direction (X), for supporting said cups (C1, C2, C3) in a suspended position raised from any surface of the beverage dispensing machine or base of the holder device thereby avoiding a bottom of said cups (C1, C2, C3) from touching said any surface of the beverage dispensing machine or base of the holder device, said cup holding body (2) having a wall provided with a lateral aperture (11) extending vertically along said cup holding body and having a width at each step sufficient for withdrawal of the cups (C1, C2) by the user through sliding of the cups on respective ones of the steps (3, 4), said steps (3, 4, 8) being positioned relative to each other so that the cups (C1, C2, C3) are held only one cup at any one time by respective ones of said steps (3, 4, 8) and so that for an arrangement in which one of the cups is supported by an uppermost one of the steps, an immediately lower one of the steps is positioned at an elevation lower than that of the uppermost one of the steps, the widths at the respective steps being dimensioned so that for the arrangement in which the one of the cups is supported by the uppermost one of the step, the immediately lower one of the steps avoids interfering with withdrawal of the one of the cups in a horizontal direction from the uppermost one of the steps even though the width at the immediately lower one of the steps is smaller in dimension than the width at the uppermost one of the steps.

3. The device according to claim 2, wherein said cups (C1, C2, C3) are differently sized and in that the number of steps (3, 4, 8) corresponds to the number of cup sizes, each of said steps (3, 4, 8) supporting one of said differently sized cups (C1, C2, C3) at its upper portion.

4. The device according to claim 2, wherein said cup holding body (2) is funnel shaped.

5. The device according to claim 2, wherein each of said steps (3, 4, 8) supports a related cup (C1, C2, C3) at its upper edge (5, 6, 9).

6. The device according to claim 2, wherein one of said steps at least (3, 4) is formed by a narrowing of the internal surface of the cup holding body (2).

7. The device according to claim 2, wherein one of the at least two steps (3, 4) runs continuously on said internal surface of the cup holding body (2).

8. The device according to claim 7, wherein said internal surface of the cup holding body (2) has a circular cross section and the one of said at least two steps (3, 4) runs along a circumference of the same.

9. The device according to claim 2, wherein said cup holding body (2) is coupled to at least one chute (7, 8) for guiding a cup (C1, C2) dropped into said body (2).

10. A beverage dispensing machine comprising at least a dropping unit for a given size cups, characterized in that it comprises the conveyor and holder device according to claim 2.

11. The beverage dispensing machine according to claim 10, further comprising at least one chute (7, 8) to collect dropped cups (C1, C2) from the respective dropping unit and guiding the same into said body (2).

12. The beverage dispensing machine according to claim 10, wherein said conveyor and holder (1) is located over a horizontal surface (10) and the height of each of said steps (3, 4, 8) with respect to said surface (10) is greater than the height of the larger size cup (C1, C2, C3).

13. A method of delivering a beverage from a beverage dispensing machine, the method comprising the steps of dropping one of a plurality of cups (C1, C2, C3) of different diameters into at least one beverage dispensing area of said machine in a cup dropping direction (X);

filling the said one of said plurality of cups (C1, C2) with said beverage for delivery to the user;

holding suspended said one of said plurality of cups (C1, C2) at a height with respect to the cup dropping direction (X) with a cup holding body (2) so as to prevent a bottom of said one of said plurality of cups (C1, C2) from touching any surface of said beverage dispensing machine, an internal surface of said cup holding body (2) being provided with at least two steps (3, 4, 8), positioned at different heights of said cup holding body (2) with respect to the cup dropping direction (X), for supporting said cups (C1, C2, C3) in a suspended position raised from any surface of the dispensing machine or base of the cup holding body thereby avoiding the bottom of said cups (C1, C2, C3) from touching said any surface of the dispensing machine or base of the cup holding body, said cup holding body (2) having a wall provided with a lateral aperture (11) extending vertically along said cup holding body and having a width at each step sufficient for withdrawal of the cups (C1, C2) by the user through sliding of the cups on respective ones of the steps (3, 4), said steps (3, 4, 8) being positioned relative to each other so that the cups (C1, C2, C3) are held only one cup at any one time by respective ones of said steps (3, 4, 8);

supporting one of the cups by an uppermost one of the steps; and positioning an immediately lower one of the steps at an elevation lower than that of the uppermost one of the steps, the widths at the respective steps being dimensioned so that, with the one of the plurality of cups supported by the uppermost one of the step, the immediately lower one of the steps avoids interfering with withdrawal of the one of the cups in a horizontal direction from the uppermost one of the steps even though the width at the immediately lower one of the steps is smaller in dimension than the width at the uppermost one of the steps.

* * * * *